US008104756B2

(12) United States Patent
Bridges

(10) Patent No.: US 8,104,756 B2
(45) Date of Patent: Jan. 31, 2012

(54) METHOD AND APPARATUS FOR SELECTING MEDIA TRAYS FOR HOLE PUNCHING IN AN IMAGE PRODUCTION DEVICE

(75) Inventor: Richard Bridges, London (GB)

(73) Assignee: Xerox Corporation, Norwalk, CT (US)

( * ) Notice: Subject to any disclaimer, the term of this patent is extended or adjusted under 35 U.S.C. 154(b) by 295 days.

(21) Appl. No.: 12/606,216

(22) Filed: Oct. 27, 2009

(65) Prior Publication Data

US 2011/0095470 A1 Apr. 28, 2011

(51) Int. Cl.
*B65H 37/04* (2006.01)

(52) U.S. Cl. ..... 270/58.07; 399/407; 399/23; 271/9.03; 271/9.05

(58) Field of Classification Search ..... 270/58.07, 270/58.08; 271/9.02, 9.03, 9.05; 399/23, 399/391, 393, 407, 410
See application file for complete search history.

(56) References Cited

U.S. PATENT DOCUMENTS 4,819,021 A 4/1989 Doery
5,628,502 A 5/1997 Amarakoon
5,991,556 A * 11/1999 Yamashita ..... 399/23
6,869,010 B2 3/2005 Morson
7,770,880 B2 * 8/2010 Yamazaki ..... 271/9.05
2006/0228122 A1 * 10/2006 Kamei et al. ..... 399/23
2007/0071462 A1 * 3/2007 Koitabashi ..... 399/23
2008/0075479 A1 * 3/2008 Genda ..... 399/23

FOREIGN PATENT DOCUMENTS

JP 04255872 A * 9/1992
JP 2003280876 A * 10/2003

* cited by examiner

*Primary Examiner* — Patrick Mackey
(74) *Attorney, Agent, or Firm* — Ronald E. Prass, Jr.; Prass LLP

(57) ABSTRACT

A method and apparatus for selecting media trays for hole punching in an image production device in an image production device is disclosed. The method may include receiving a request to print a print job, the print job having a required number of media sheets, determining if print job requires hole punching, wherein if it is determined that print job requires hole punching, determining the media sheet capacity of one or more media trays, determining if the capacity of one of the one or more media trays is greater or equal to the number of media sheets required for the print job, wherein if it is determined that the capacity of one of the one or more media trays is greater or equal to the number of media sheets required for the print job, selecting one of the one or more media trays having the required number of media sheets for the print job, and printing the print job with media from the selected media tray.

21 Claims, 3 Drawing Sheets

METHOD AND APPARATUS FOR SELECTING MEDIA TRAYS FOR HOLE PUNCHING IN AN IMAGE PRODUCTION DEVICE

BACKGROUND

Disclosed herein is a method for selecting media trays for hole punching in an image production device, as well as corresponding apparatus and computer-readable medium.

In conventional image production devices, the concept of auto switching between media trays is used should a media tray run out of media in the middle of a print job. In this manner, the print job may be switched to another media tray that may contain the same media.

However, if the print job requires hole punching by the finishing (output) section of the image production device, the switching of media trays causes issues with the overall print job. The implementation of hole punching and the tray positioning method in conventional feeding modules the location of the punched holes to the sheet edge can be very different between media trays. As a result, if auto switching occurs in the middle of a hole punch finishing job, then the hole alignment in the media sheets between the section of the print job from the original tray and the section of the print job from the second "switched to" tray could be out of alignment specification for desired for the print job.

SUMMARY

A method and apparatus for selecting media trays for hole punching in an image production device in an image production device is disclosed. The method may include receiving a request to print a print job, the print job having a required number of media sheets, determining if print job requires hole punching, wherein if it is determined that print job requires hole punching, determining the media sheet capacity of one or more media trays, determining if the capacity of one of the one or more media trays is greater or equal to the number of media sheets required for the print job, wherein if it is determined that the capacity of one of the one or more media trays is greater or equal to the number of media sheets required for the print job, selecting one of the one or more media trays having the required number of media sheets for the print job, and printing the print job with media from the selected media tray.

DETAILED DESCRIPTION

Figure 1:
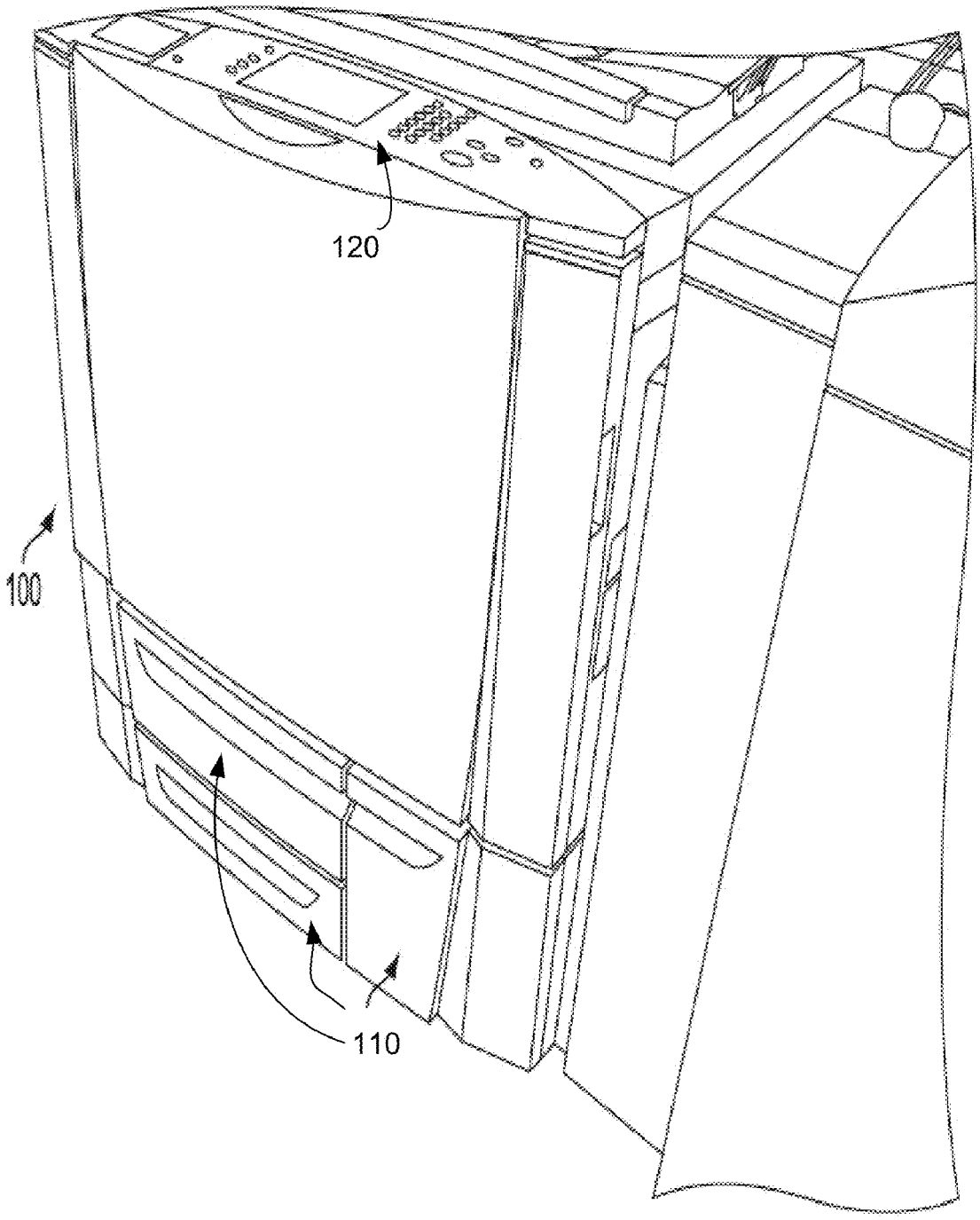
FIG. 1 is an exemplary diagram of an image production device in accordance with one possible embodiment of the disclosure.

Aspects of the embodiments disclosed herein relate to a method for selecting media trays for hole punching in an image production device, as well as corresponding apparatus and computer-readable medium.

The disclosed embodiments may include a method for selecting media trays for hole punching in an image production device. The method may include receiving a request to print a print job, the print job having a required number of media sheets, determining if print job requires hole punching, wherein if it is determined that print job requires hole punching, determining the media sheet capacity of one or more media trays, determining if the capacity of one of the one or more media trays is greater or equal to the number of media sheets required for the print job, wherein if it is determined that the capacity of one of the one or more media trays is greater or equal to the number of media sheets required for the print job, selecting one of the one or more media trays having the required number of media sheets for the print job, and printing the print job with media from the selected media tray.

The disclosed embodiments may further include an image production device that may include a media tray capacity measurement unit that measures the capacity of one or more media trays, and a media tray selection unit that receives a request to print a print job, the print job having a required number of media sheets, determines if print job requires hole punching, wherein if the media tray selection unit determines that print job requires hole punching, the media tray selection unit receives the media sheet capacity of one or more media trays from the media tray capacity measurement unit, determines if the capacity of one of the one or more media trays is greater or equal to the number of media sheets required for the print job, wherein if the media tray selection unit determines that the capacity of one of the one or more media trays is greater or equal to the number of media sheets required for the print job, the media tray selection unit selects one of the one or more media trays having the required number of media sheets for the print job, and prints the print job with media from the selected media tray.

The disclosed embodiments may further include a computer-readable medium storing instructions for controlling a computing device for selecting media trays for hole punching in an image production device. The instructions may include receiving a request to print a print job, the print job having a required number of media sheets, determining if print job requires hole punching, wherein if it is determined that print job requires hole punching, determining the media sheet capacity of one or more media trays, determining if the capacity of one of the one or more media trays is greater or equal to the number of media sheets required for the print job, wherein if it is determined that the capacity of one of the one or more media trays is greater or equal to the number of media sheets required for the print job, selecting one of the one or more media trays having the required number of media sheets for the print job, and printing the print job with media from the selected media tray.

The disclosed embodiments may concern a method and apparatus for selecting media trays for hole punching in an image production device. This process may include a control sequence that makes the decision to switch media trays based on the expected capacity of the media tray and the number of sheets required to complete the job rather than the original tray running out of media.

In this manner, if a print job requires hole punching, the process of the disclosed embodiments may either:

- Print the job from the requested or selected media tray should the default or selected tray capacity meet the requirements for the print job;
- Switch or select a media tray prior to the print job commencing should the a default or previously selected media tray capacity not meet the job requirements; or
- Prompt the user to load media sheets into one or more media trays if a print job requires hole punching and the one or more media trays do not have the media sheet capacity to print the print job.

Implementation of this process may prevent a user from receiving print jobs with mid-print job offset hole punch alignment due to mid-print job auto tray switching.

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include one or more media trays 110 and a local user interface 120. The one or more media trays 110 may be opened by a user so that media may be checked, replaced, or to investigate a media misfeed or jam, for example. The media in the media trays 110 may be any type, color, size or thickness, for example.

The user interface 120 may contain one or more display screen (which may be a touchscreen or simply a display, for example), and a number of buttons, knobs, switches, etc. to be used by a user to control image production device 100 operations. The one or more display screen may also display warnings, alerts, instructions, and information to a user. While the user interface 120 may accept user inputs, another source of image data and instructions may include inputs from any number of computers to which the printer is connected via a network, for example.

Figure 2:
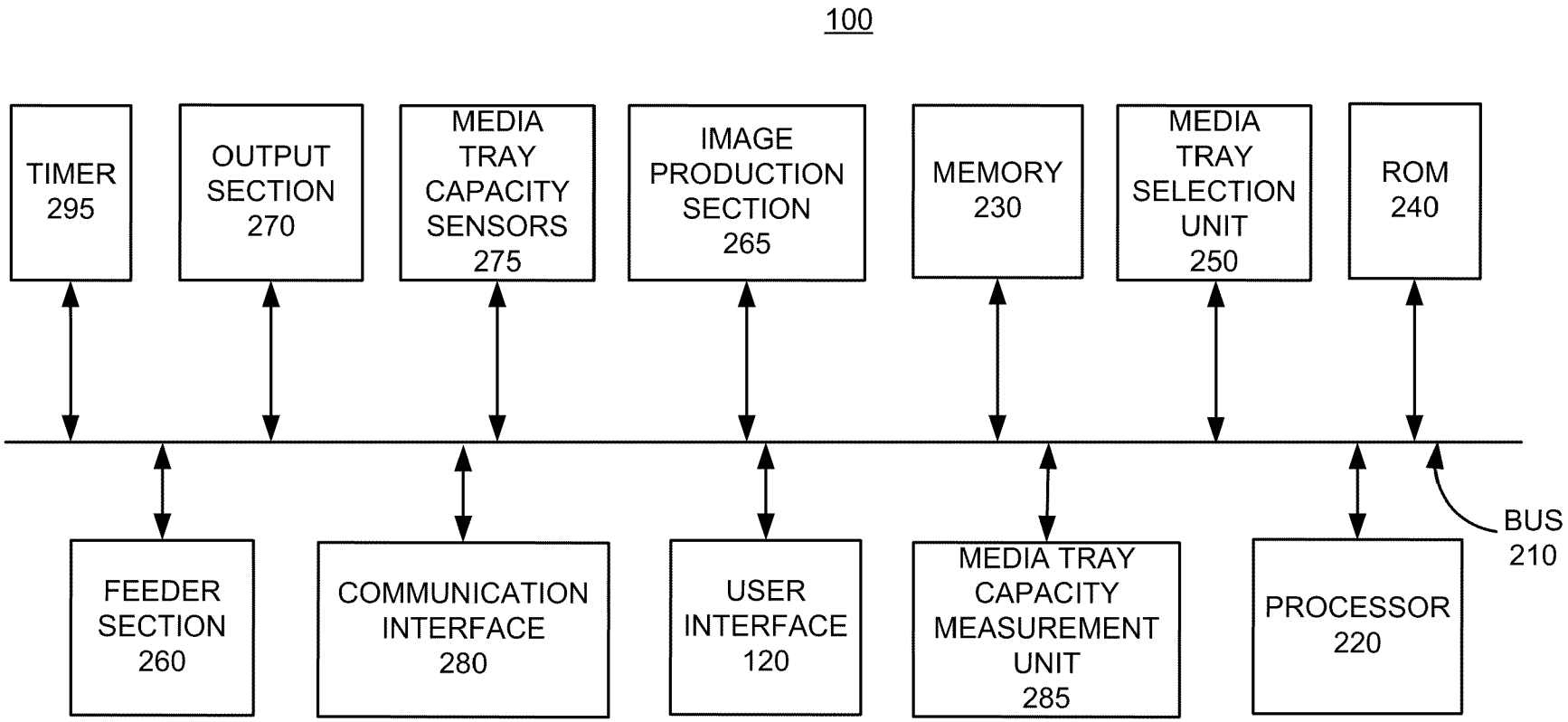
FIG. 2 is a exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, the media tray selection unit 250, the user interface 120, a feeder section 260, an image production section 265, an output section 270, a communication interface 280, and a media capacity measurement unit 285, one or more media tray capacity sensors 275, and one or more timers 295. Bus 210 may permit communication among the components of the image production device 100.

The image production section 265 may include hardware by which image signals are used to create a desired image. The stand-alone feeder section 260 may store and dispense media sheets on which images are to be printed. The output section 270 may include hardware for stacking, folding, stapling, binding, etc., prints which are output from the image production section. If the image production device 100 is also operable as a copier, the image production device 100 may further includes a document feeder and scanner which may operate to convert signals from light reflected from original hard-copy image into digital signals, which are in turn processed to create copies with the image production section 265.

With reference to feeder section 260, the section may include one or more media trays, each of which stores a media stack or print sheets ("media") of a predetermined type (size, weight, color, coating, transparency, etc.) and may include a feeder to dispense one of the media sheets therein as instructed.

The one or more timers 295 may be any type of software or hardware timer known to one of skill in the art and may be used to determined capacity in a media tray 110. In one possible embodiment, the length of time the media tray 110 takes to be raised, may determine the capacity of the media tray 110 (may vary according to media sheet thickness and other factors, for example). Thus, the longer it may take for a media tray 110 to be raised, the fewer number of media sheets may be in the media tray. The one or more timers 295 may be set to a predetermined value and decremented or the one or more timers 295 may be incremented until reaching a certain predetermined value. Once one or more media trays 110 are raised into position, the one or more timers 295 may activated. One timer may be used for all media tray 110 raising situations or events, or separate timers 295 may be used for media tray 110 raising situations or events, for example.

The one or more media tray capacity sensors 275 may be any sensor known to one of skill in the art that may sense and/or compute the capacity of a media tray. The sensors may include an infrared sensor, a Light-Emitting Diode (LED) sensor, a contact sensor, etc.

Certain types of media may require special handling in order to be dispensed properly. For example, heavier or larger media may desirably be drawn from a media stack by use of an air knife, fluffer, vacuum grip or other application (not shown in the Figure) of air pressure toward the top sheet or sheets in a media stack. Certain types of coated media may be advantageously drawn from a media stack by the use of an application of heat, such as by a stream of hot air (not shown in the Figure). Sheets of media drawn from a media stack on a selected media tray may then be moved to the image production section 265 to receive one or more images thereon. Then, the printed sheet is then moved to output section 270, where it may be collated, stapled, folded, hole punched, etc., with other media sheets in manners familiar in the art. Hole punching may occur any time during the printing process, for example, and may be described in detail in U.S. Pat. Nos. 5,628,502 and 6,869,010, which are incorporated by reference in their entireties.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 120 may include one or more conventional mechanisms that permit a user to input information to and interact with the image production device 100, such as a keyboard, a display, a mouse, a pen, a voice recognition device, touchpad, buttons, etc., for example. Output section 270 may include one or more conventional mechanisms that output image production documents to the user, including output trays, output paths, finishing section, etc., for example. The image production section 265 may include an image printing and/or copying section, a scanner, a fuser, etc., for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like that are capable of displaying the print release marking and can be scanned by the image production device.

The operation of components of the media tray selection unit 250, media tray capacity measurement unit 285, and the media tray selection process will be discussed in relation to the flowchart in FIG. 3.

Figure 3:
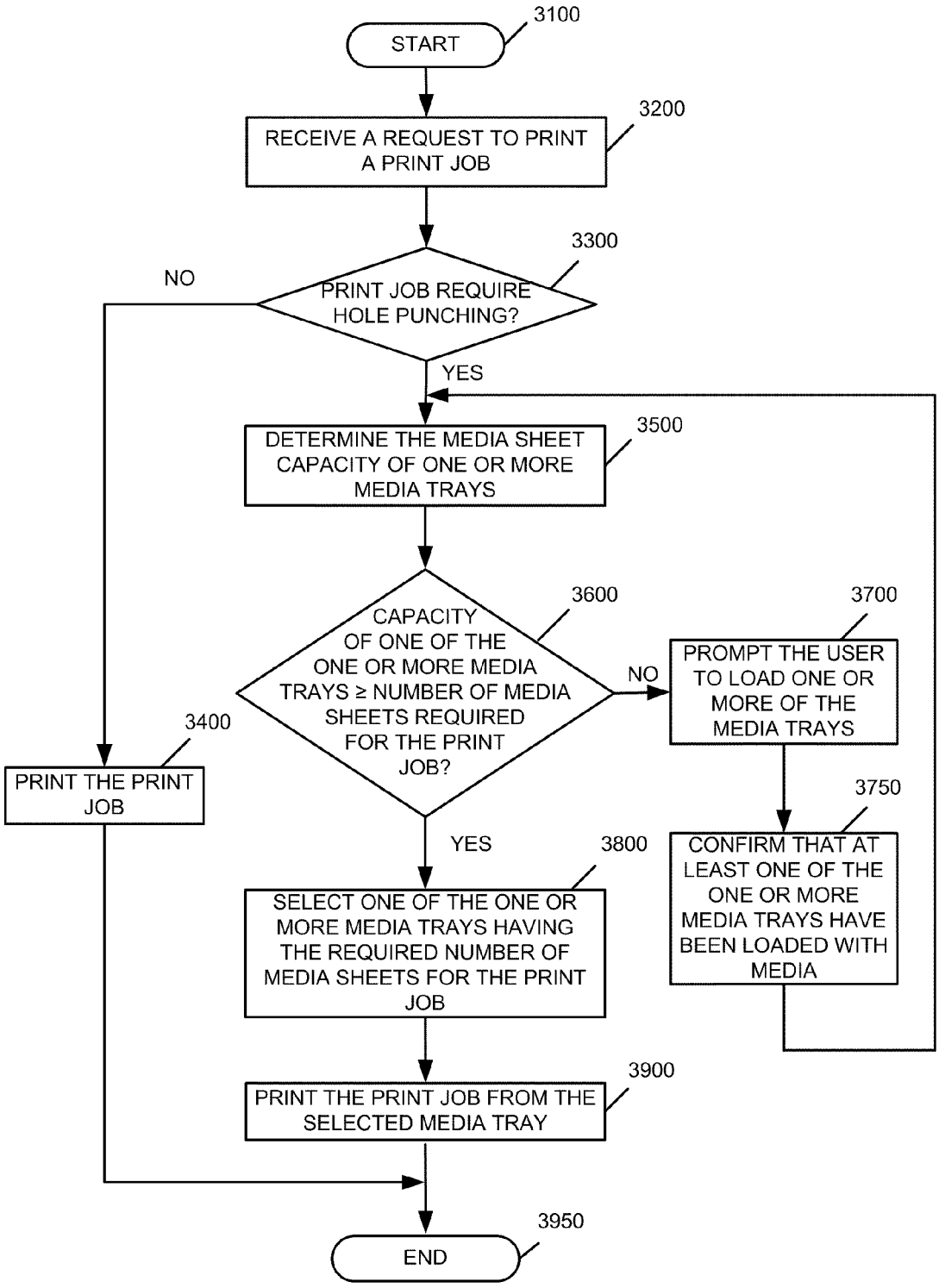
FIG. 3 is a flowchart of an exemplary media tray selection process in accordance with one possible embodiment of the disclosure.

FIG. 3 is a flowchart of a media tray selection process in accordance with one possible embodiment of the disclosure. The method may begin at 3100, and may continue to 3200 where the media tray selection unit 250 may receive a request to print a print job. The print job may require a number of media sheets to complete the print job.

At step 3300, the media tray selection unit 250 may determine if the print job requires hole punching. If the media tray selection unit 250 determines that print job does not require hole punching, the process goes to step 3400, where the media tray selection unit 250 may print the print job in the normal manner. In particular, the print job may be printed such that a default or first media tray 110 may supply the media and if the media in the first tray should run out, a switch may occur to permit the print job to be completed using another media tray 110. The process may then go to step 3950 and end.

However, if at step 3300 the media tray selection unit 250 determines that print job requires hole punching, at step 3500, the media tray selection unit 250 may receive the media sheet capacity of one or more media trays 110 from the media tray capacity measurement unit 285. At step 3600, the media tray selection unit 250 may determine if the capacity of one of the one or more media trays 110 is greater or equal to the number of media sheets required for the print job. The media capacity measurement unit 285 may determine the capacity of the one or more media trays using a timer 295 that records the time it takes to raise a media tray 110 into a feed-ready position, a media tray capacity sensor 275 that may sense the capacity of the one or more media trays 110, or any other technique of measuring media tray capacity known to one of skill in the art.

If the media capacity measurement unit 285 determines that the capacity of one of the one or more media trays 110 is not greater or equal to the number of media sheets required for the print job, the process goes to step 3700 where the media tray selection unit 250 may prompt a user to load one or more of the media trays 110 with media. The media tray selection unit 250 may wait for the user to load the media into at least one of the one or more media trays 110. At step 3750, the media tray selection unit 250 may confirm that media has been loaded into at least one of the one or more media trays 110. The confirmation may be done through the use of sensors or a prompt to the user to confirm that media has been loaded, for example. The process may then return to step 3500 to resume the printing process.

However, if at step 3600 the media tray selection unit 250 determines that the capacity of one of the one or more media trays 110 is greater or equal to the number of media sheets required for the print job, at step 3800, the media tray selection unit 250 may select one of the one or more media trays 110 having the required number of media sheets for the print job. At step 3900, the media tray selection unit 250 may print the print job with media from the selected media tray 110. The process may then go to step 3950 and end.

Note that in keeping with the disclosed embodiments, if the media capacity measurement unit 285 determines the capacity of a default media tray 110 and if the media tray selection unit 250 determines that the capacity of the default media tray 110 is not greater or equal to the number of media sheets required for the print job, the media capacity measurement unit 285 may determine the media sheet capacity of a second media tray 110 and if the media tray selection unit 250 determines that the capacity of the second media tray 110 is greater or equal to the number of media sheets required for the print job, the media tray selection unit 250 selects the second media tray and the print job is printed with media from the second media tray 110. However, if the media capacity measurement unit 285 determines that the capacity of the second media tray 110 is greater or equal to the number of media sheets required for the print job, the media tray selection unit 250 prompts a user to load media in at least one of the default media tray 110 and the second media tray 110.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for selecting media trays for hole punching in an image production device, comprising:

receiving a request to print a print job, the print job having a required number of media sheets;

determining if print job requires hole punching, wherein if it is determined that print job requires hole punching, determining the media sheet capacity of one or more media trays;

determining if the capacity of one of the one or more media trays is greater or equal to the number of media sheets required for the print job, wherein if it is determined that the capacity of one of the one or more media trays is greater or equal to the number of media sheets required for the print job, selecting one of the one or more media trays having the required number of media sheets for the print job; and printing the print job with media from the selected media tray.

2. The method of claim 1, wherein the capacity of a default media tray is determined first and if the capacity of the default media tray is not greater or equal to the number of media sheets required for the print job, the media sheet capacity of a second tray is determined and if the capacity of the second media tray is greater or equal to the number of media sheets required for the print job, the second media tray is selected and the print job is printed with media from the second media tray.

3. The method of claim 2, wherein if the capacity of the second media tray is greater or equal to the number of media sheets required for the print job, prompting a user to load media in at least one of the default media tray and the second media tray.

4. The method of claim 1, wherein if it is determined that print job does not require hole punching, printing the print job.

5. The method of claim 1, wherein if it is determined that the capacity of one of the one or more media trays is not greater or equal to the number of media sheets required for the print job, prompting a user to load one or more of the media trays with media.

6. The method of claim 1, wherein the capacity of the one or more media trays are determined using one of the time it takes to raise the media tray into a feed-ready position, and a sensor reading.

7. The method of claim 1, wherein the image production device is one of a copier, a printer, a facsimile device, and a multi-function device.

8. An image production device, comprising:

a media tray capacity measurement unit that measures the capacity of one or more media trays; and a media tray selection unit that receives a request to print a print job, the print job having a required number of media sheets, determines if print job requires hole punching, wherein if the media tray selection unit determines that print job requires hole punching, the media tray selection unit receives the media sheet capacity of one or more media trays from the media tray capacity measurement unit, determines if the capacity of one of the one or more media trays is greater or equal to the number of media sheets required for the print job, wherein if the media tray selection unit determines that the capacity of one of the one or more media trays is greater or equal to the number of media sheets required for the print job, the media tray selection unit selects one of the one or more media trays having the required number of media sheets for the print job, and prints the print job with media from the selected media tray.

9. The image production device of claim 8, wherein the media capacity measurement unit determines the capacity of a default media tray is and if the media tray selection unit determines that the capacity of the default media tray is not greater or equal to the number of media sheets required for the print job, the media capacity measurement unit determines the media sheet capacity of a second tray and if the media tray selection unit determines that the capacity of the second media tray is greater or equal to the number of media sheets required for the print job, the media tray selection unit selects the second media tray and the print job is printed with media from the second media tray.

10. The image production device of claim 9, wherein if the media capacity measurement unit determines that the capacity of the second media tray is greater or equal to the number of media sheets required for the print job, the media tray selection unit prompts a user to load media in at least one of the default media tray and the second media tray.

11. The image production device of claim 8, wherein if the media tray selection unit determines that print job does not require hole punching, the media tray selection unit prints the print job.

12. The image production device of claim 8, wherein if the media capacity measurement unit determines that the capacity of one of the one or more media trays is not greater or equal to the number of media sheets required for the print job, the media tray selection unit prompts a user to load one or more of the media trays with media.

13. The image production device of claim 8, wherein the media capacity measurement unit determines the capacity of the one or more media trays using one of a timer that records the time it takes to raise the media tray into a feed-ready position, and a media tray capacity sensor that sense the capacity of the one or more media trays.

14. The image production device of claim 8, wherein the image production device is one of a copier, a printer, a facsimile device, and a multi-function device.

15. A computer-readable medium storing instructions for controlling a computing device for selecting media trays for hole punching in an image production device, the instructions comprising:

receiving a request to print a print job, the print job having a required number of media sheets;

determining if print job requires hole punching, wherein if it is determined that print job requires hole punching, determining the media sheet capacity of one or more media trays;

determining if the capacity of one of the one or more media trays is greater or equal to the number of media sheets required for the print job, wherein if it is determined that the capacity of one of the one or more media trays is greater or equal to the number of media sheets required for the print job, selecting one of the one or more media trays having the required number of media sheets for the print job; and printing the print job with media from the selected media tray.

16. The computer-readable medium of claim 15, wherein the capacity of a default media tray is determined first and if the capacity of the default media tray is not greater or equal to the number of media sheets required for the print job, the media sheet capacity of a second tray is determined and if the capacity of the second media tray is greater or equal to the number of media sheets required for the print job, the second media tray is selected and the print job is printed with media from the second media tray.

17. The computer-readable medium of claim 16, wherein if the capacity of the second media tray is greater or equal to the number of media sheets required for the print job, prompting a user to load media in at least one of the default media tray and the second media tray.

18. The computer-readable medium of claim 15, wherein if it is determined that print job does not require hole punching, printing the print job.

19. The computer-readable medium of claim 15, wherein if it is determined that the capacity of one of the one or more media trays is not greater or equal to the number of media sheets required for the print job, prompting a user to load one or more of the media trays with media.

20. The computer-readable medium of claim 15, wherein the capacity of the one or more media trays are determined using one of the time it takes to raise the media tray into a feed-ready position, and a sensor reading.

21. The computer-readable medium of claim 15, wherein the image production device is one of a copier, a printer, a facsimile device, and a multi-function device.

* * * * *